US005598648A

United States Patent [19]

Moriya et al.

[11] Patent Number: 5,598,648

[45] Date of Patent: Feb. 4, 1997

[54] APPARATUS FOR CONTROLLING STRAIGHT EXCAVATING OPERATION WITH HYDRAULIC EXCAVATOR

[75] Inventors: Yukio Moriya; Shigeru Kinoshita; Takumi Onoda; Toshio Yokoyama, all of Hirakata, Japan

[73] Assignee: Kabushiki Kaisha Komatsu Seisakusho, Hirakata, Japan

[21] Appl. No.: 671,795

[22] PCT Filed: Aug. 2, 1990

[86] PCT No.: PCT/JP90/00986

§ 371 Date: Sep. 9, 1991

§ 102(e) Date: Sep. 9, 1991

[87] PCT Pub. No.: WO91/02125

PCT Pub. Date: Feb. 21, 1991

[30] Foreign Application Priority Data

Aug. 2, 1989 [JP] Japan ..... 1-200549

[51] Int. Cl.[6] ..... E12F 3/32

[52] U.S. Cl. ..... 37/348; 414/379; 414/443

[58] Field of Search ..... 414/699, 694, 414/700, 708; 37/DIG. 1, DIG. 14, DIG. 20, 414, 443, 348; 91/450

[56] References Cited

U.S. PATENT DOCUMENTS

| | | | |
|---|---|---|---|
| 3,472,127 | 10/1969 | Scheidt . | |
| 3,606,049 | 9/1971 | Gordon | 414/694 |
| 4,046,270 | 9/1977 | Baron et al. | 414/699 X |
| 4,377,043 | 3/1983 | Inui et al. | 414/699 X |

FOREIGN PATENT DOCUMENTS

| | | |
|---|---|---|
| 0389136 | 9/1990 | European Pat. Off. . |
| 47-30501 | 12/1972 | Japan . |
| 55-168559 | 5/1980 | Japan . |
| 58-47833 | 3/1983 | Japan . |
| 58219551 | 6/1985 | Japan . |
| 63190989 | 2/1990 | Japan . |

*Primary Examiner*—Michael S. Huppert
*Assistant Examiner*—Donald W. Underwood
*Attorney, Agent, or Firm*—Welsh & Katz, Ltd.

[57] ABSTRACT

The present invention is concerned with an apparatus for controlling a straight excavating operation with a hydraulic excavator such as a power shovel or the like machine including three working units, i.e., a boom, an arm and a bucket. When the straight excavating operation is performed, a hydraulic pressure of hydraulic oil in a hydraulic chamber on the boom lowering side of a boom cylinder is conducted to a drain tank while maintaining a predetermined set pressure, and a hydraulic pressure of hydraulic oil in a hydraulic chamber on the boom raising side of the boom cylinder is conducted to the drain tank via a check valve which serves to inhibit the hydraulic oil from flowing from the hydraulic chamber on the boom raising side of the boom cylinder to the drain tank, whereby the boom is held in the so-called floated state so as to enable a straight excavating operation to be performed merely by actuating the arm and bucket. In addition, according to the present invention, the apparatus is provided with an automatic bucket driving system for automatically controlling the present bucket angle so as to coincide with a preset bucket angle. This system contributes to remarkable reduction of a load to be borne by an operator while a straight excavating operation is performed.

4 Claims, 6 Drawing Sheets

APPARATUS FOR CONTROLLING STRAIGHT EXCAVATING OPERATION WITH HYDRAULIC EXCAVATOR

TECHNICAL FIELD

The present invention relates to an apparatus for controlling a straight excavating operation with a hydraulic excavator such as a power shovel or the like machine including three working units, i.e., a bucket, an arm and a boom wherein the straight excavating operation can exactly be performed by simple actuations.

BACKGROUND ART

Hitherto, a straight excavating operation such as a horizontal planing operation, a normal planing operation or the like has been performed with a hydraulic excavator such as a power shovel or the like machine by adequately actuating a boom lever, an arm lever and a bucket lever with operator s hand for actuating a boom, an arm and a bucket. However, since the actuations as mentioned above are compositely accomplished, respectively, an operator is required to perform a very troublesome actuating operation with a high skill.

In view of the aforementioned problem, various proposals have been heretofore made with respect to an automation technology employable for a straight excavating operation. FIG. 7 is a graph which illustrates by way of example a conventional automation technology as disclosed in an official gazette of Japanese Published Patent NO. 36135/ 1983. According to the conventional automation technology, a boom 1, an arm 2 and a bucket 3 include turn pins 4, 5 and 6 each of which is equipped with an angle sensor. The angle sensors for the boom 1, the arm 2 and the bucket 3 are practically utilized such that in response to detection signals $\theta_1$, $\theta_2$ and $\theta_3$ from the angle sensors, the y-coordinate of a bucket edge relative to a preset height D preset for a straight excavating operation is calculated with the aid of a computer based on distances $l_1$, $l_2$ and $l_3$ between the turn pins 4, 5 and 6, the preset height D and a distance $y_0$ from the preset height D up to the turn pin 4 and turnable movement of each of the boom 1, the arm 2 and bucket 3 is then controlled so as to allow the. y-coordinate to be reduced to zero.

However, it has been found that the conventional automation technology has a problem that all the turn pins 4, 5 and 6 for the boom 1, the arm 2 and bucket 3 are required to have an angle sensor attached thereto, respectively. In addition, with respect to the conventional automation technology, since the Y-coordinate of the bucket edge requiring a large quantity of complicated calculating operations is calculated with the aid of the computor, there arises another problem that installation of a computor having a larger capacity is required if a property of responsiveness should be raised up.

The present invention has been made with the foregoing background in mind and its object resides in providing an apparatus for controlling a straight excavating operation with a hydraulic excavator wherein the straight excavating operation can be performed by simple actuations with an excellent property of responsiveness at an inexpensive cost with the aid of the apparatus which is constructed with a simple structure.

DISCLOSURE OF THE INVENTION

To accomplish the above object, there is provided according to one aspect of the present invention an apparatus for a controlling a straight excavating operation with a hydraulic excavator wherein a boom, an arm and a bucket are driven by a boom cylinder, an arm cylinder and a bucket cylinder and the hydraulic excavator includes a hydraulic boom driving system, a hydraulic arm driving system and a hydraulic bucket driving system for hydraulically driving the boom cylinder, the arm cylinder and the bucket cylinder in response to an actuation signal, respectively, wherein the apparatus comprises a first hydraulic passageway by way of which a hydraulic pressure of hydraulic oil in a hydraulic chamber on the boom lowering side of the boom cylinder is connected to a drain tank, a solenoid valve for opening and closing the first hydraulic passageway, a second hydraulic passageway by way of which a hydraulic chamber on the boom raising side of the boom cylinder is connected to the drain tank, a check valve disposed on the second hydraulic passageway so as to inhibit a hydraulic oil from flowing from the hydraulic chamber on the boom raising side of the boom cylinder to the drain tank, and actuation switch means for instructing actuation of the solenoid valve so as to allow it to be opened or closed, whereby when a straight excavating operation is performed, the solenoid valve is opened by the actuation switch means and thereby the boom is held in the floated state.

With such construction, the hydraulic pressure of hydraulic oil in the hydraulic chamber on the boom lowering side of the boom cylinder is maintained at a suitable level of pressure during a straight excavating operation and a hydraulic oil is supplemented to the hydraulic chamber on the boom raising side of the boom cylinder via the check valve. Therefore, while the foregoing operative state is maintained, there is not a possibility that the boom is lowered by its own dead weight. When an operator actuates the arm so as to allow it to be turned in the inward direction while the foregoing operative state is maintained, the reactive force transmitted to the bottom surface of the bucket from the ground surface is exerted on the boom cylinder via the bucket, the arm and the boom so as to allow the boom to be raised up. As a result, the boom is raised up as desired. Since the hydraulic chamber on the boom lowering side of the boom cylinder is communicated with the drain tank while the hydraulic pressure in the hydraulic chamber is maintained at a predetermined level of pressure during the raising operation of the boom, in a case where the bucket receives a large magnitude of load due to collision of the bucket with a large rock or the like obstacle during a straight excavating operation, the boom is immediately raised up to avoid the collision of the bucket with the large rock. On the contrary, in a case where the bucket receives a small magnitude of load having a value lower than a preset pressure of the hydraulic oil in the hydraulic chamber on the boom lowering side of the boom cylinder due to collision of the bucket with a small rock or the like obstacle, the straight excavating operation is continuously performed without any necessity for avoiding the collision of the bucket with the small rock.

Therefore, according to the present invention, a straight excavating operation can be performed merely by actuating the arm and the bucket with the aid of the apparatus which is constructed with a simple structure at an inexpensive cost.

In addition, according to other aspect of the present invention, there is provided an apparatus for controlling a straight excavating operation with a hydraulic excavator wherein a boom, an arm and a bucket are driven by a boom cylinder, an arm cylinder and a bucket cylinder and the hydraulic excavator includes a hydraulic boom driving system, a hydraulic arm driving system and a hydraulic bucket driving system for hydraulically driving the boom cylinder, the arm cylinder and the bucket cylinder in response to an actuation signal, respectively, wherein the apparatus comprises a first hydraulic passageway by way of which a hydraulic pressure of hydraulic oil in a hydraulic chamber on the boom lowering side of the boom cylinder is conducted to a drain tank, a solenoid valve for opening and closing the first hydraulic passageway, a second hydraulic passageway by way of which a hydraulic chamber on the boom raising side of the boom cylinder is connected to the drain tank, a check valve disposed on the second hydraulic passageway so as to inhibit a hydraulic oil from flowing from the hydraulic chamber on the boom raising side of the boom cylinder to the drain tank, a bucket angle sensor for detecting a bucket angle, bucket angle setting means for setting the bucket angle, straight excavating operation instructing means for instructing start or stop of a straight excavating operation, and controlling means adapted to perform a controlling operation such that when start of a straight excavating operation is instructed by the straight excavating operation instructing means, the solenoid valve is turned on to open the first hydraulic passageway and moreover operation of the hydraulic bucket driving system is controlled so as to reduce a difference between the preset bucket angle preset by the bucket angle setting means and the bucket angle detected by the bucket angle sensor to zero, whereby the boom is held in the floated state during a straight excavating operation and moreover the bucket is automatically driven so as to allow the bucket angle detected by the bucket angle sensor to coincide with the preset bucket angle.

With such construction, while a straight excavating operation is performed, the boom is held in the floated state and the bucket is automatically driven so as to allow the preset bucket angle to coincide with the bucket angle detected by the bucket angle sensor with the aid of the apparatus which is constructed in the same manner as the apparatus according to the one aspect of the present invention. Since a straight excavating operation is performed merely by actuating the arm, a load to be borne by an operator can be reduced further. It should be noted that when a bucket actuating lever is actuated during the straight excavating operation, the value corresponding to an actuation signal is added to the value corresponding to the preset bucket angle so that the bucket angle is easily changed during the straight excavating operation.

Therefore, according to the present invention, once a bucket angle is preset before a straight excavating operation is performed, the bucket is automatically driven such that the bucket angle detected by the bucket angle sensor coincides with the preset bucket angle. Thus, there is no need of actuating the bucket actuating lever. In addition, since a hydraulic pressure of hydraulic oil in the hydraulic chamber on the boom lowering side of the boom cylinder is conducted to the drain tank via the solenoid valve which is controlled to assume a predetermined extent of opening, the hydraulic pressure in the hydraulic chamber on the boom lowering side of the boom cylinder is exerted on the boom so as to allow it to be raised up while maintaining a predetermined intensity of hydraulic pressure. This makes it possible to perform a straight excavating operation by independently actuating the arm only, resulting in the load to be borne by the operator being reduced. Additionally, according to the present invention, when the bucket actuating lever is actuated with one operator' s hand during the straight excavating operation, the value corresponding to a actuation signal is added to the value corresponding to the preset bucket angle and the bucket angle is then controlled with the result derived from the addition as a target. Thus, even in a case where there arises a necessity that the bucket angle is changed to another one in the course of the straight excavating operation, the preset value of the bucket angle can easily be changed without interruption of the straight excavating operation.

BEST MODE FOR CARRYING OUT THE INVENTION

Now, the present invention will be described in detail hereinafter with reference to the accompanying drawings which illustrate preferred embodiments of the present invention.

Figure 1:
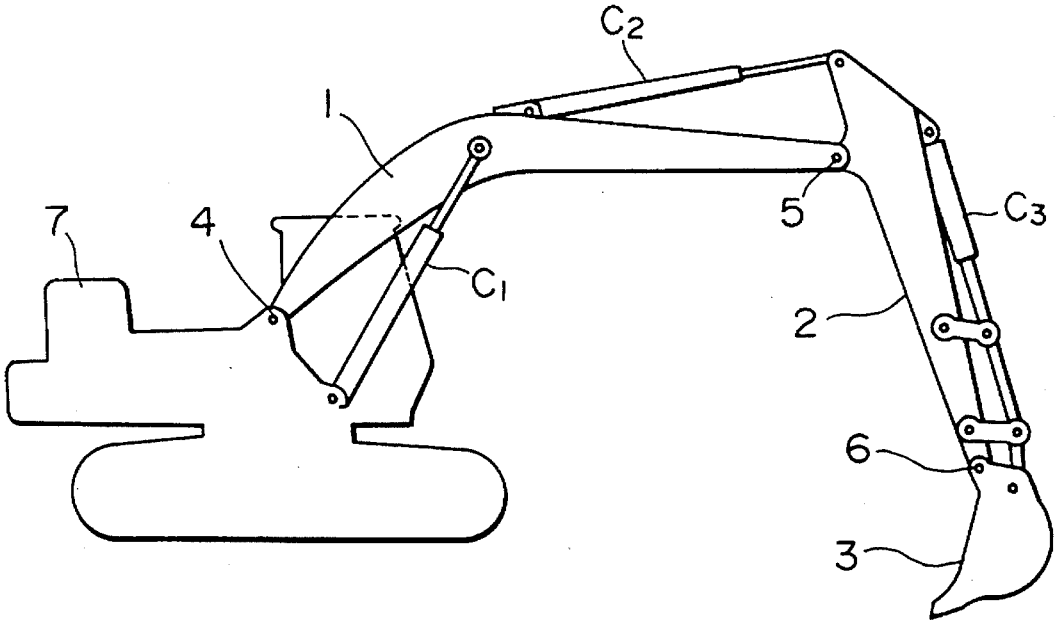
FIG. 1 is an illustrative view which shows by way of appearance the structure of a power shovel.

FIG. 1 is an illustrative view which shows by way of appearance the structure of a power shovel. This power shovel includes a boom 1, an arm 2 and a bucket 3 as working units. The boom 1, the arm 2 and the bucket 3 are driven by a boom cylinder $C_1$, an arm cylinder $C_2$ and a bucket cylinder $C_3$ each of which serves as an actuator for the working unit. In FIG. 1, reference numeral 4 designates a turn pin for the boom 1, reference numeral 5 designates a turn pin for the arm 2, reference numeral 6 designates a turn pin for the bucket 3 and reference numeral 7 designates a vehicle body.

Figure 2:
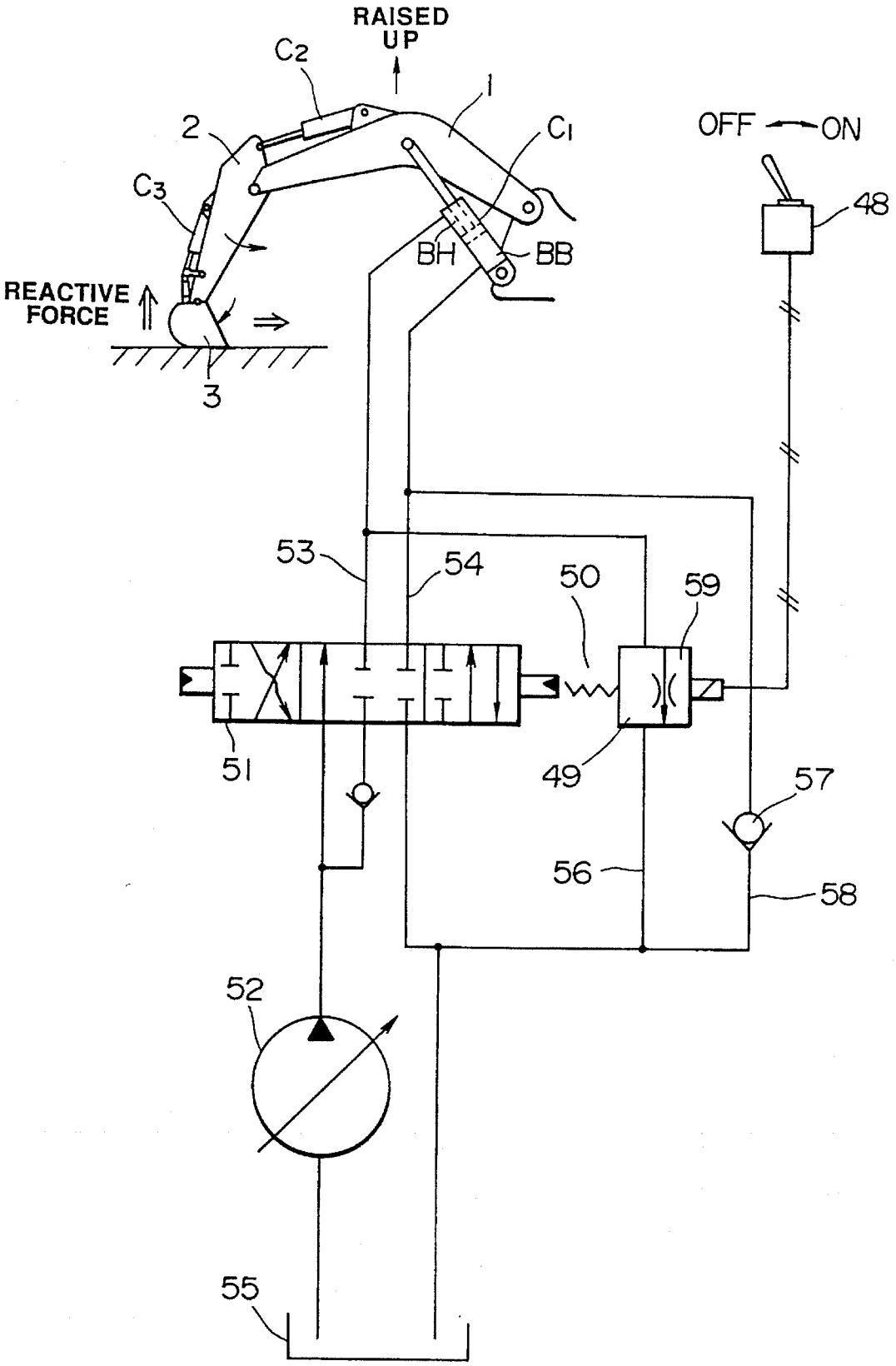
FIG. 2 is a hydraulic circuit diagram which schematically illustrates an apparatus for controlling a straight excavating operation with a hydraulic excavator in accordance with a first embodiment of the present invention.

FIG. 2 is a hydraulic circuit diagram which schematically illustrates an apparatus for controlling a straight excavating operation with a hydraulic excavator in accordance with a first embodiment of the present invention. The boom 1 is lowered by feeding to a hydraulic chamber BH on the head side of the boom cylinder C1 a pressurized hydraulic oil delivered from a hydraulic pump 52 by actuating a direction changing valve 51 or the boom 1 is raised up by feeding the hydraulic oil to a hydraulic chamber BB on the bottom side of the boom cylinder C1 by actuating the direction changing valve 51 in the opposite direction. A switch 48 is arranged to hold the boom 11 in the so-called "floated" state when a straight excavating operation is performed. When the switch 48 is shifted to ON, the boom 1 is brought in the "floated" state. In the meantime, when a normal excavating operation is performed, the switch 48 is shifted to OFF.

With this construction, a pipe line 53 extending from the hydraulic chamber BH on the head side of the boom cylinder $C_1$ is connected to a bypass pipe line 56 which in turn is connected to a drain tank 55. In addition, a proportional solenoid valve 49 is disposed on the bypass pipe line 56 and a pipe line 54 extending from the hydraulic chamber BB on the bottom side of the boom cylinder $C_1$ is connected to the drain tank 55 via a check valve 57. It should be noted that the proportional solenoid valve 49 is equipped with a throttle 59. Although illustration is omitted, the arm cylinder $C_2$ and the bucket cylinder $C_3$ are connected to a direction changing valve similar to the direction changing valve 51 for the boom 1, respectively, so that the arm 2 and the bucket 3 are turnably driven when an operator actuates steering levers for the working units to shift the direction changing valves for the arm cylinder $C_2$ and the bucket cylinder $C_3$ in the predetermined direction.

According to the first embodiment of the present invention, when a straight excavating operation such as a plowing operation, a normal planing operation or the like is performed, the operator shifts the direction changing valve 51 to a neutral position while the bottom surface of the bucket 3 is brought in contact with the ground surface by actuating a boom steering lever for the boom 1. Subsequently, he shifts the switch 48 to ON.

As a result, the proportional solenoid valve 49 is displaced from the closed state to the opened state against the resilient force of a spring 50, whereby the passageway leading to the drain tank 55 which has been kept closed till this time and the hydraulic chamber BH on the head side of the boom cylinder $C_1$ are communicated with each other via the throttle 59. This causes the hydraulic chamber BH on the head side of the boom cylinder $C_1$ to be loaded with a certain intensity of hydraulic pressure. On the other hand, the hydraulic chamber BB on the bottom side of the boom cylinder $C_1$ is supplemented with a hydraulic oil from the drain tank 55 via the check valve 57 so as to compensate a shortage of quantity of hydraulic oil in the hydraulic chamber BB on the bottom side of the boom cylinder $C_1$. Therefore, as long as the foregoing operative state is maintained, there is not a possibility that the boom 1 is lowered by its own dead weight. When the arm cylinder $C_2$and the bucket cylinder $C_3$ are driven to turn the arm 2 in the inward direction by actuating steering levers (not shown) for steering them with operator' hands while the foregoing operative state is maintained, the reactive force transmitted to the bottom surface of the bucket 3 from the ground surface is exerted on the boom cylinder $C_1$ via the bucket 3, the arm 2 and the boom 1 so as to allow the boom 1 to be raised up. As a result, the boom 1 is raised up as desired. Since the hydraulic chamber BH on the head side of the boom cylinder $C_1$ is communicated with the drain tank 55 via the throttle 59 during the raising operation of the boom 1, in a case where the bucket 3 receive a large magnitude of load due to collision of the bucket 3 with a large rock or the like obstacle during a straight excavating operation, the boom 1 is immediately raised up by actuating the steering levers with operator's hands to avoid the collision of the bucket 3 with the large rock. On the contrary, when the bucket 3 receives a load corresponding to a value smaller than a preset pressure of hydraulic oil in the hydraulic chamber BH on the head side of the boom cylinder $C_1$ due to collision of the bucket 3 with a small rock or the like obstacle, a straight excavating operation is continuously performed without any necessity for avoiding the collision of the bucket 3 with the small rock.

As is apparent from the above description, according to the first embodiment of the present invention, the apparatus is constructed such that the hydraulic chamber BH on the head side of the boom cylinder C1 is connected to the drain tank 55 via the throttle 59 and a hydraulic circuit is separately arranged so as to allow the boom 1 to be held in the so-called "floated" state while the hydraulic chamber BB on the bottom side of the cylinder 1 permits a hydraulic oil to freely flow therein but inhibits a hydraulic oil from flowing therefrom to the drain tank 59 with the aid of the check valve 57. It should be noted that the foregoing hydraulic circuit is operated by shifting the switch 48 in the predetermined direction. Therefore, when a straight excavating operation is performed, the operator is required to actuate the arm 2 and the bucket 3 only, resulting in a load to be borne by the operator being reduced substantially.

Figure 3:
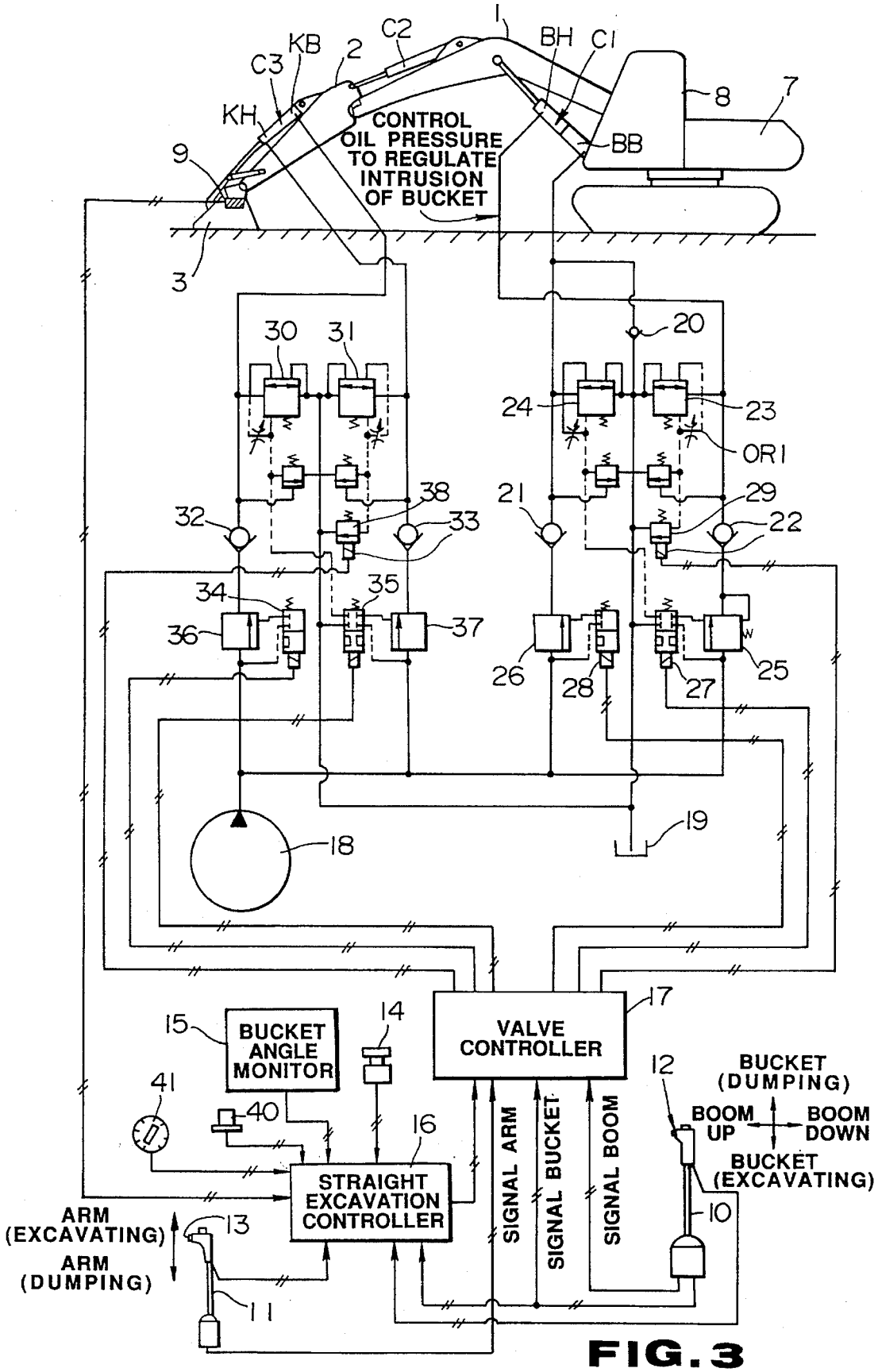
FIG. 3 is a hydraulic circuit diagram which schematically illustrates an apparatus for controlling a straight excavating operation with a hydraulic excavator in accordance with a second embodiment of the present invention.
Figure 4:
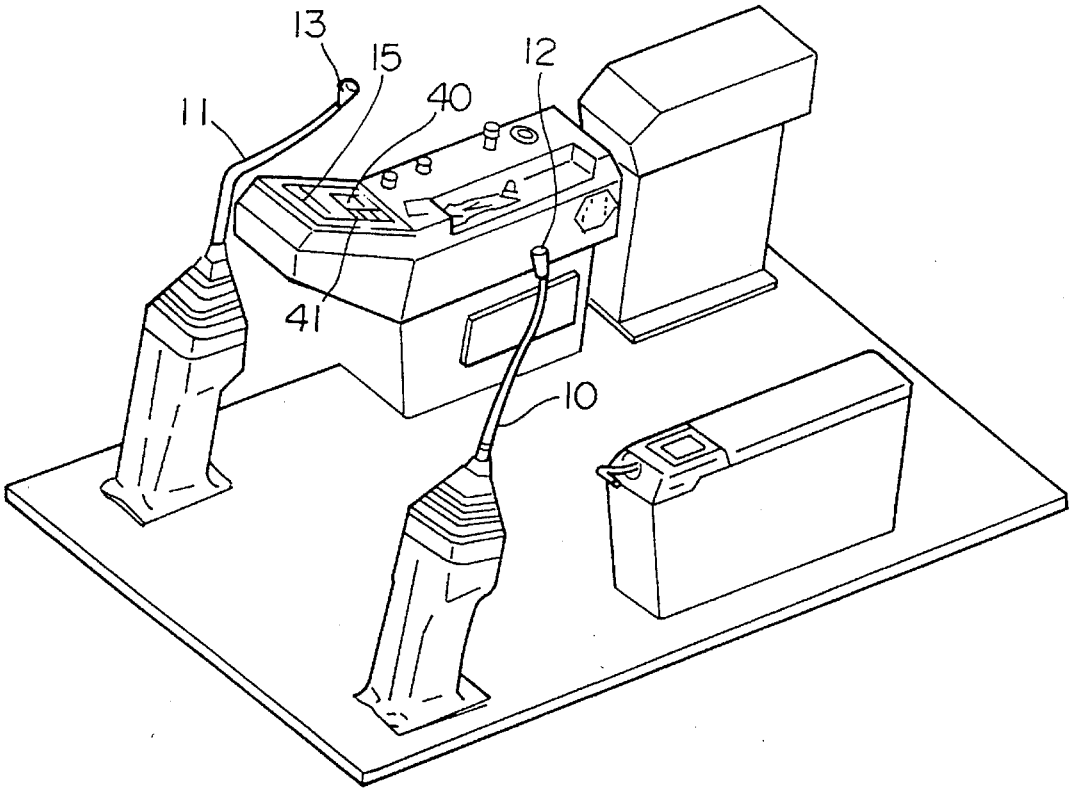
FIG. 4 is a perspective view which illustrates arrangement of a bucket angle setting switch, a monitor and others in an operator cabin.

FIG. 3 and FIG. 4 show an apparatus for controlling a straight excavating operation with a hydraulic excavator in accordance with a second embodiment of the present invention, respectively. FIG. 3 is a hydraulic circuit diagram which illustrates arrangement of hydraulic circuits for the apparatus and FIG. 4 is a perspective view which illustrates arrangement of actuating levers for the working units and a monitor in an operator cabin. According to the second embodiment of the present invention as shown in FIG. 3 and FIG. 4, the apparatus is provided with a hydraulic circuit which allows the boom 1 to be held in the "floated" state in the same manner as the first embodiment of the present invention. In addition, the apparatus is additionally provided with an automatic driving system for automatically driving the bucket 3 so as to allow the bucket 3 to assumes a bucket angle which coincides with a preset bucket angle at all time.

In FIG. 3 and FIG. 4, reference numeral 8 designates an operator cabin, reference numeral 9 designates a bucket angle sensor, reference numeral 10 designates a bucket boom actuating lever, reference numeral 11 designates an arm actuating lever, reference numerals 12 and 13 designate a straight excavating operation start switch, respectively, reference numeral 14 designates a straight excavating operation mode switch, reference numeral 15 designates a bucket angle setting monitor, reference numeral 16 designates a controller for a straight excavating operation, reference numeral 17 designates a valve controller, reference numeral 18 designates a hydraulic pump, reference numeral 19 designates a drain tank, reference numeral 40 designates a bucket angle setting switch and reference numeral 41 designates a float setting pressure selection switch. Among the aforementioned components, the straight excavating operation start switches 12 and 13 disposed on knobs of the bucket boom actuating lever 10 and the arm actuating lever 11 are intended to instruct start and stop of a straight excavating operation. Both switches 12 and 13 have the same function. Specifically, when one of the two switches 12 and 13 is shifted to ON, it instructs start of a straight excavating operation. When an operator shifts to OFF the switch which has been shifted to ON, the straight excavating operation is stopped. The straight excavating operation mode switch 14 is actuated by the operator when he designates a straight excavating operation mode. The float setting pressure selection switch 41 is intended to selectively set a value of hydraulic pressure in the hydraulic chamber BH on the head side of the boom cylinder $C_1$ when the boom 1 is required to assume a float mode. A plurality of different hydraulic pressure values can be set for the switch 41 depending on the present soil condition.

In addition, the apparatus is provided with a hydraulic boom driving system for driving the boom cylinder $C_1$. This system includes check valves 20 to 22, boom meter-out valves 23 and 24, boom meter-in valves 25 and 26, pilot valves 27 and 28 and a boom meter-out pilot valve 29 as essential components. When the boom 1 is raised up, the pilot valve 28 and the boom meter-out pilot value 29 are turned on, respectively. When the boom 1 is lowered, the pilot valve 27 is turned on. In addition, when the boom 1 is held in the floated state, the boom meter-out pilot valve 29 only is turned on.

Further, the apparatus is provided with a hydraulic bucket driving system for driving the bucket 3. This system includes bucket meter-out valves 30 and 31, check valves 32 and 33, pilot valves 34 and 35, bucket meter-in valves 36 and 37 and a bucket meter-out pilot valve 38 as essential components. When the bucket 3 is turned to the excavating operation side, the pilot valve 34 and the bucket meter-out pilot valve 38 are turned on. When the bucket 3 is turned to the dumping operation side, the pilot valve 35 only is turned on.

Although illustration is omitted, the apparatus is provided with a hydraulic driving system for driving the arm 2. This system is similar to the hydraulic boom driving system and the hydraulic bucket driving system in structure. As shown in FIG. 4, the bucket boom actuating lever 10, the arm actuating lever 11, the straight excavating operation start switches 12 and 13, the bucket angle setting monitor 15, the bucket angle setting switch 40 and the float setting pressure selection switch 41 are arranged in the operator cabin 8, respectively.

With such construction, when a straight excavating operation is performed, the boom 1, the arm 2 and the bucket 3 are turned to required straight excavating operation start positions by adequately actuating the bucket boom actuating lever 10 and the arm actuating lever 11 with operator's hands. Thereafter, the straight excavating operation mode switch 14 is shifted to ON and a suitable set pressure corresponding to the present soil condition is selected by actuating the float setting pressure selection switch 41. Additionally, a required bucket angle is set on the screen of the bucket angle setting monitor 15 by adequately actuating the bucket angle setting switch 40. On completion of the setting operation, the operator shifts to ON one of the straight excavating operation start switches 12 and 13 disposed on the knobs of the bucket boom actuating lever 10 and the arm actuating lever 11 to instruct start of a straight excavating operation.

In response to this instruction, the straight excavating operation controller 16 instructs the valve controller 17 to start a straight excavating operation. In addition, the controller 16 determines a difference between the preset bucket angle preset by the bucket angle setting switch 40 and the bucket angle detected by the bucket angle sensor 9, inputs a bucket driving command value into the valve controller 17 so as to allow the foregoing difference to be reduced to zero and moreover inputs into the valve controller 17 a value representative of a hydraulic pressure of hydraulic oil in the hydraulic chamber BH on the head side of the boom cylinder $C_1$ when the float mode is selected.

After the signals representative of the aforementioned instructions are inputted into the valve controller 17, the pilot valve 29 is opened by allowing a control signal corresponding to the set pressure inputted into the boom meter-out pilot valve 29 to be inputted into the valve controller 17. The boom meter-out pilot valve 29 is constructed in the form of a proportional solenoid valve of which spool is opened to the extent of opening corresponding to the control signal inputted into the valve controller 17.

When the boom meter-out pilot valve 29 is opened, a differential pressure is generated across an orifice $OR_1$ disposed in the boom meter-out valve 23 and the boom meter-out valve 23 is then opened by the differential pressure. As a result, the hydraulic chamber BH on the head side of the boom cylinder C1 is connected to a drain tank 19 via the boom meter-out valve 23. On the other hand, the hydraulic chamber BB on the bottom side of the boom cylinder C1 is connected to the drain tank 19 via the check valve 20, whereby the boom 1 can be held in the "floated" state in the same manner as the first embodiment of the present invention. Specifically, when an outer force is exerted on the boom 1 so as to allow the boom 1 to be raised up while the foregoing state is maintained, the working oil in the hydraulic chamber BH on the head side of the boom cylinder C1 is returned to the drain tank 19 while maintaining a predetermined hydraulic pressure, causing the boom 1 to be held in the so-called "floated" state.

On the other hand, the valve controller 17 performs a controlling operation for inputting a control signal into the pilot valves 34 and 35 and the bucket meter-out pilot valve 38 in accordance with a bucket driving command value which causes a difference between the preset bucket angle inputted from the straight excavating operation controller 16 and the actual bucket angle to be reduced to zero. Specifically, the valve controller 17 performs a controlling operation such that when the bucket 3 is turned to the excavating operation side, the pilot valve 34 and the bucket meter-out pilot valve 38 are turned on and when the bucket 3 is turned to the dumping operation side, the pilot valve 35 only is turned on. Additionally, the valve controller 17 performs an automatic controlling operation so as to reduce a difference between the preset bucket angle and the actual bucket angle to zero at all times by controlling the pilot valves 34 and 35 and the bucket meter-out pilot valve 38 in accordance with the bucket driving command value inputted from the straight excavating operation controller 16.

Therefore, when the arm 2 is driven so as to allow the arm 2 to approach the vehicle body 7 by actuating the arm actuating lever with one operator's hand, the reactive force transmitted to the bottom surface of the bucket 3 from the ground surface is exerted on the boom cylinder C1 via the arm 2 so that the boom cylinder C1 is raised up. As a result, the hydraulic pressure of hydraulic oil in the hydraulic chamber BH on the head side of the boom cylinder C1 is regulated corresponding to a quantity of intrusion of the bucket 3 into the ground, and the hydraulic oil is drained to the drain tank 19 while maintaining a predetermined hydraulic pressure in conformity with a control signal inputted into the pilot valve 29. In the meantime, when the reactive force transmitted to the bottom surface of the bucket 3 from the ground surface exceeds a value corresponding to the foregoing predetermined pressure, the boom 1 is raised up automatically.

Figure 5:
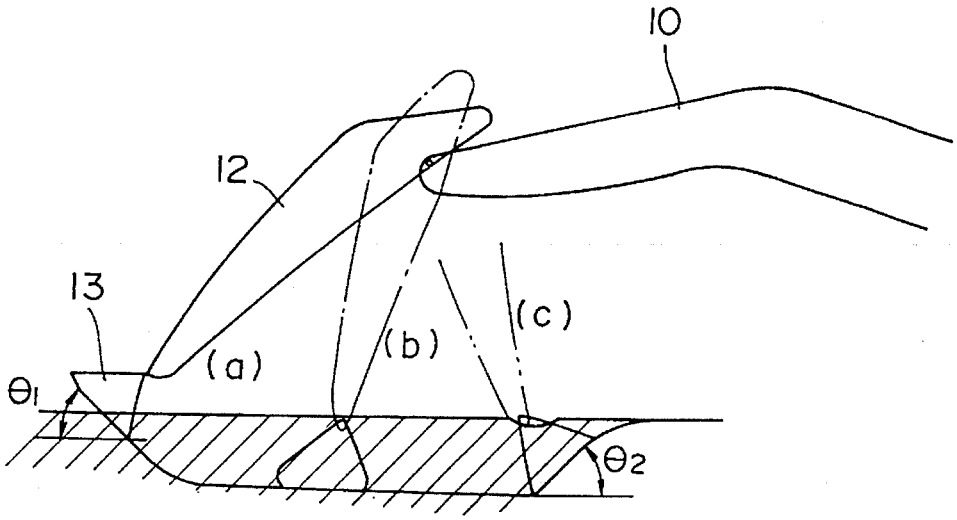
FIG. 5 is a schematic view which illustrates variation of a bucket angle during a straight excavating operation.

With the construction of the apparatus as shown in FIG. 3, when a bucket actuating signal is inputted into the straight excavating operation controller 16 by actuating the bucket actuating lever 10 with one operator's hand during a straight excavating operation, the value corresponding to the bucket actuating signal is added to the preset bucket angle which has been preset by the bucket angle setting switch 40, and the result derived from the addition is used as a new preset bucket angle which in turn causes an automatic controlling operation to be performed for the bucket angle. Therefore, also in a case where the bucket angle is set by the bucket angle setting switch 40 prior to a straight excavating operation to orient in the horizontal direction, when the bucket 3 is turned to the dumping operation side by an angle θ1 relative to the horizontal plane by actuating the bucket actuating lever 10 with one operator's hand, a straight excavating operation can be performed with the bucket angle θ1, as shown in FIG. 5(*a*). In addition, when the bucket actuating lever 10 is restored to the neutral position in the course of the straight excavating operation, a straight excavating operation can be performed while the bucket 3 is held in the horizontal direction, as shown in FIG. 5(*b*). This makes it possible to perform a horizontal excavating operation via simple actuation after the bucket 3 is intruded into the ground to some extent. In this connection, in a case where the bucket 3 is restored to the ground surface after completion of the horizontal excavating operation, when the bucket actuating lever 10 is actuated to the excavating operation side, the bucket 3 is inclined to the excavating operation side by an angle of, e.g., θ2 relative to the horizontal plane, as shown in FIG. 5(*c*). Then, the bucket 3 can be restored to the ground surface.

As is apparent from the above description, the straight excavating operation is continuously performed while the straight excavating operation mode switch 14 is shifted to ON and either one of the straight excavating operation start switches 12 and 13 is additionally shifted to ON. When the straight excavating operation switch 12 or 13 is released from ON, the straight excavating operation is stopped. It should be added that a normal excavating operation can be performed while the straight excavating operation mode switch 14 is shifted to OFF.

Figure 6:
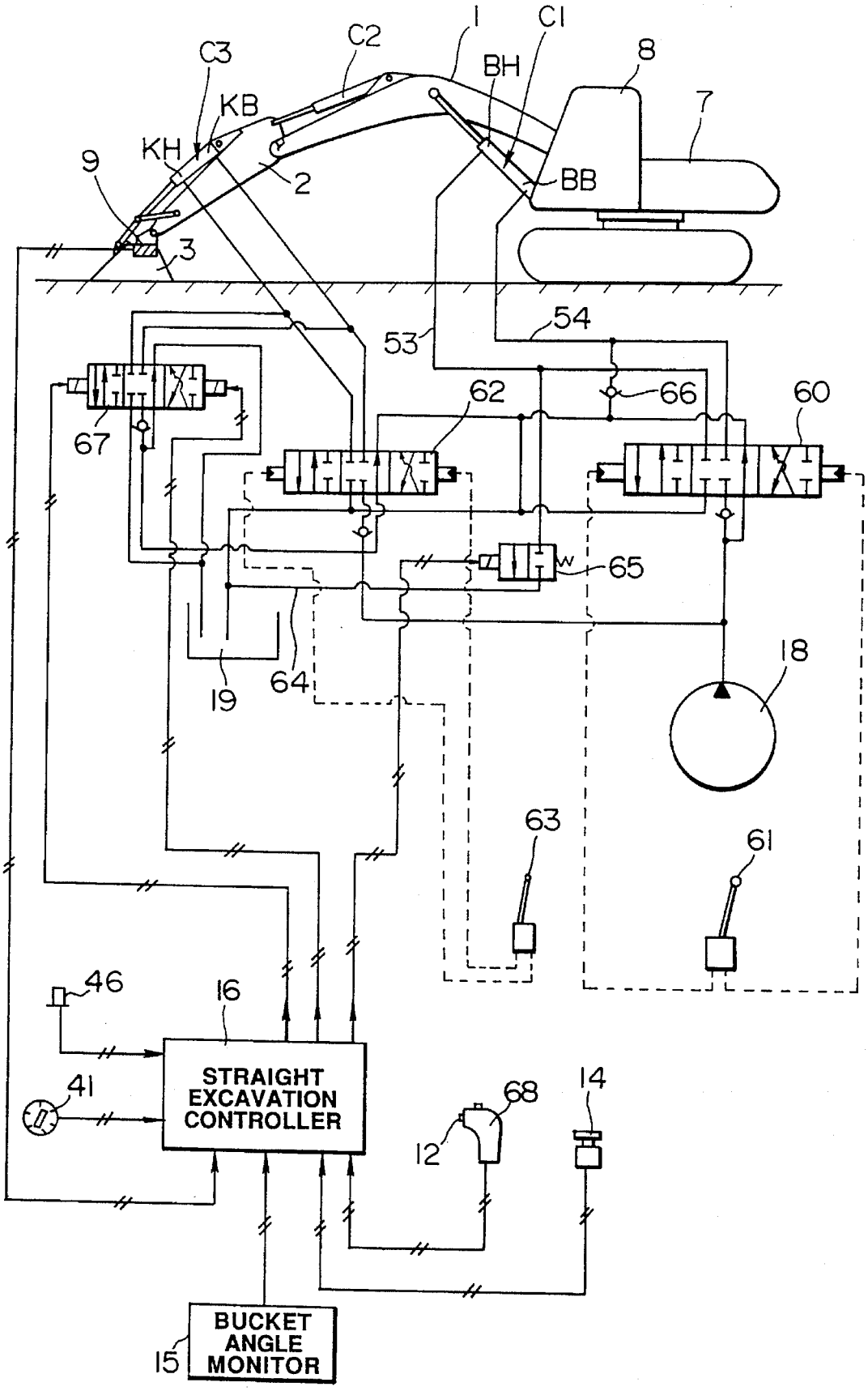
FIG. 6 is a hydraulic circuit diagram which schematically illustrates an apparatus for controlling a straight excavating operation with a hydraulic excavator in accordance with a third embodiment of the present invention and FIG. 7 is an illustrative view which shows characteristics of a prior art.
Figure 7:
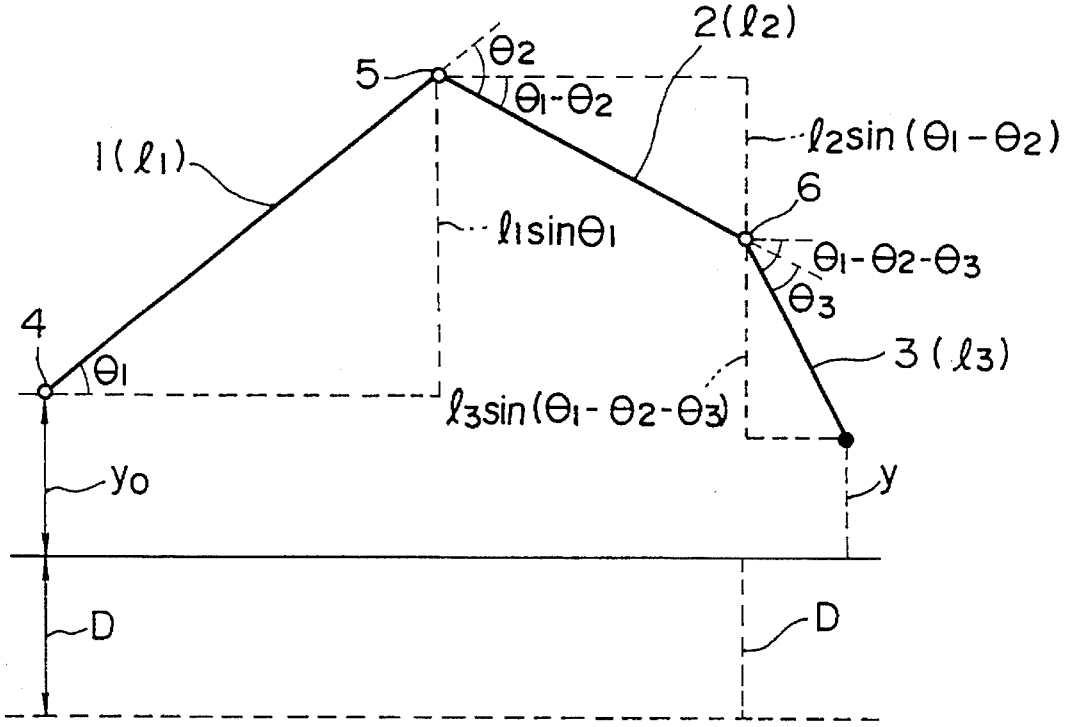

FIG. 6 is a hydraulic circuit diagram which schematically illustrates an apparatus for controlling a straight excavating operation with a hydraulic excavator in accordance with a third embodiment of the present invention. Same or similar components constituting the apparatus as those in the preceding embodiments are represented by same reference numerals. Thus, repeated description will not be required.

According to the third embodiment of the present invention, actuating valves for the bucket 3 and the boom 1 are constructed in the form of a spool valve, respectively. A boom actuating valve 60 is shifted by actuating a boom actuating lever 61, while a bucket actuating valve 62 is shifted by actuating a bucket actuating lever 63. A pipe line 53 extending from the hydraulic chamber BH on the head side of the boom cylinder C1 is connected to a bypass pipe line 64 which in turn is connected to a drain tank 19. In addition, a proportional solenoid valve 65 is disposed on the bypass pipe line 64, and a pipe line 54 extending from the hydraulic chamber BB on the bottom side of the boom cylinder C1 is connected to the drain tank 19 via a check valve 66. With such construction, the boom 1 can be held in the floated state in the same manner as the preceding embodiments.

Additionally, the apparatus is provided with a proportional solenoid valve 67 for automatically driving the bucket 3 so that the bucket 3 is automatically driven by controlling the proportional solenoid valve 67 with the aid of the straight excavating operation controller 16. The straight excavating operation start switch 12 is disposed on a predetermined knob lever 68.

With such construction, when a straight excavating operation is performed, the straight excavating operation mode switch 14 is first shifted to ON with one operator's hand after the boom 1, the arm 2 and the bucket 3 are displaced to required positions for starting the straight excavating operation. Then, a suitable setting pressure corresponding to the present soil condition is selected by actuating the float setting pressure selection switch 41 and a required bucket angle is set on the screen of the bucket angle setting monitor 15 by adequately actuating a bucket angle setting switch 40. On completion of the setting operation, the operator instructs start of the straight excavating operation by shifting the straight excavating operation start switch 12 on the knob lever 68 to ON.

In response to the instruction, the straight excavating operation controller 16 opens the proportional solenoid valve 65 by allowing a control signal corresponding to the set pressure inputted into the proportional solenoid valve 65 to be inputted thereinto. Once the proportional solenoid valve 65 is opened, the hydraulic chamber BH on the head side of the boom cylinder C1 is connected to the drain tank 19. On the other hand, the hydraulic chamber BB on the bottom side of the boom cylinder C1 is connected to the drain tank 19 via a check valve 66, whereby the boom 1 can be held in the "floated" state in the same manner as the second embodiment of the present invention. Specifically, when an outer force is exerted on the boom 1 to raise up the same while the foregoing operative state is maintained, the working oil in the hydraulic chamber BH on the head side of the boom cylinder C1 is returned to the drain tank 19 while maintaining a predetermined hydraulic pressure, whereby the boom 1 is brought in the so-called "floated" state.

At the same time as the aforementioned controlling operation is performed, the straight excavating operation controller 16 automatically controls the bucket 3 so as to reduce a difference between the preset bucket angle and the actual bucket angle to zero at all times by determining a difference between the preset bucket angle preset by the bucket angle setting switch 40 and the actual angle detected by the bucket angle sensor 9 and then inputting into the proportional solenoid valve 67 a bucket driving command value which causes the foregoing difference to be reduced to zero.

Therefore, when the arm 2 is driven so as to allow the arm 2 to approach the vehicle body 7 by actuating an arm actuating lever (not shown) with one operator's hand, the reactive force transmitted to the bottom surface of the bucket 3 from the ground surface is exerted on the boom cylinder C1 via the arm 2 so as to raise up the boom cylinder C1. As a result, the working pressure of hydraulic oil in the hydraulic chamber BH on the head side of the boom cylinder C1 is regulated corresponding to a quantity of intrusion of the bucket 3 into the ground. Thereafter, the hydraulic oil is drained to the drain tank 19 while maintaining a predetermined hydraulic pressure corresponding to the control signal inputted into the proportional solenoid valve 63. When the reactive force transmitted to the bottom surface of the bucket 3 from the ground surface exceeds a value corresponding to the predetermined hydraulic pressure, the boom 1 is raised up automatically.

With the construction of the apparatus as shown in FIG. 6, when the bucket actuating lever 63 is actuated with one operator's hand while the straight excavating operation mode is maintained, the working oil flowing in response to actuation of the bucket actuating lever 63 drives the bucket cylinder C3 in cooperation with the working oil flowing corresponding to the extent of opening of the proportional solenoid valve 67 controlled by the straight excavating operation controller 16. As a result, the result corresponding to the actuation signal derived from the bucket actuating lever 63 is added to the preset bucket angle preset by the bucket angle setting switch 40 in the same manner as the second embodiment of the present invention. Then, the result derived from the addition is used as a new preset bucket angle so that the bucket angle is automatically controlled based on the new preset bucket angle.

As is apparent from the above description, according to the second embodiment and the third embodiment of the present invention, a straight excavating operation can semi-automatically be performed merely by actuating the arm 2. Consequently, the straight excavating operation can be performed with an excellent property of responsiveness with the aid of the apparatus of the present invention which is constructed with a simple structure at an inexpensive cost. In addition, the straight excavating operation can be performed with a remarkably reduced magnitude of load to be borne by the operator.

INDUSTRIAL APPLICABILITY

The present invention can advantageously be applied to a straight excavating operation to be performed by a hydraulic excavator such as a power shovel or the like machine including three working units, i.e., a boom, an arm and a bucket.

We claim:

1. An apparatus for controlling a straight excavating operation with a hydraulic excavator wherein a boom, an arm and a bucket are driven by a boom cylinder, an arm cylinder and a bucket cylinder and said hydraulic excavator includes a hydraulic boom driving system, a hydraulic arm driving system and a hydraulic bucket driving system for hydraulically driving said boom cylinder, said arm cylinder and said bucket cylinder acting in response to an actuation signal, respectively, wherein said apparatus comprises:

a first boom meter-out valve disposed on a hydraulic passageway connecting a hydraulic chamber on a head side of said boom cylinder to a drain tank;

a first boom meter-in valve disposed on a hydraulic passageway connecting a hydraulic chamber on a bottom side of said boom cylinder to a hydraulic pump;

a second boom meter-out valve disposed on a hydraulic passageway connecting said hydraulic chamber on the bottom side of said boom cylinder to said drain tank;

a second boom meter-in valve disposed on a hydraulic passageway connecting said hydraulic chamber on the head side of said boom cylinder to said hydraulic pump;

a first pilot valve for opening and closing said first boom meter-in valve and controlling a flow rate thereof;

a boom solenoid pilot valve for cooperatively opening and closing said second boom meter-out valve and said second boom meter-in valve and controlling a flow rate thereof;

a second pilot valve for opening and closing said first boom meter-out valve and controlling a flow rate thereof;

a check valve disposed on a hydraulic passageway between said hydraulic chamber on the bottom side of said boom cylinder and said drain tank, for inhibiting hydraulic oil from flowing from said hydraulic chamber on the bottom side to said drain tank and, when said boom is raised up as being held in a floated state, for opening its valve to supplement the hydraulic oil of said drain tank to said bottom-side of said boom cylinder;

all of said boom valves being included in said hydraulic boom driving system, means for designating a straight excavating operation mode;

means for instructing start and stop of the straight excavating operation;

first control means, when an instruction for raising said boom is input from a boom actuation lever, for inputting a boom actuation signal corresponding to a displacement of said boom actuation lever to said first pilot valve and said second pilot valve to drive said first boom meter-in valve and said second boom meter-out valve and, when an instruction for lowering said boom is input from a first actuation lever, for inputting a first actuation signal corresponding to a displacement of said first actuation lever to said boom solenoid pilot valve to cooperatively drive said second boom meter-in valve and said second boom meter-out valve, and further, when the straight excavating operation mode is designated by said straight excavating operation designating means and the start of the straight excavating operation is instructed by said straight excavating operation instructing means, for turning on said second pilot valve to open said first boom meter-out valve so as to allow said hydraulic chamber on the head side of said boom cylinder to communicate with said drain tank whereby said boom is controlled to be in the floated state during the straight excavating operation;

a first bucket meter-out valve disposed on a hydraulic passageway connecting a hydraulic chamber on a head side of said bucket cylinder to said drain tank;

a first bucket meter-in valve disposed on a hydraulic passageway connecting a hydraulic chamber on a bottom side of said bucket cylinder to said hydraulic pump;

a second bucket meter-out valve disposed on a hydraulic passageway connecting said hydraulic chamber on the bottom side of said bucket cylinder to said drain tank;

a second bucket meter-in valve disposed on a hydraulic passageway connecting said hydraulic chamber on the head side of said bucket cylinder to said hydraulic pump;

a third pilot valve for opening and closing said first bucket meter-in valve and controlling a flow rate thereof;

a bucket solenoid pilot valve for cooperatively opening and closing said second bucket meter-out valve and said second bucket meter-in valve and controlling a flow rate thereof;

a third bucket meter-out pilot valve for opening and closing said first bucket meter-out valve and controlling a flow rate thereof;

all of said bucket valves being included in said hydraulic bucket driving system, a bucket angle sensor for detecting a bucket angle;

bucket angle setting means for setting the bucket angle; and second control means, when an instruction for a bucket excavating operation is input from a bucket actuation lever, for inputting a bucket actuation signal corresponding to a displacement of said bucket actuation lever to said third pilot valve and said third bucket meter-out pilot valve to drive said first bucket meter-in valve and said first bucket meter-out valve and, when an instruction for a bucket dumping operation is input from a second actuation lever, for inputting a second actuation lever signal corresponding to a displacement of said second actuation lever to said bucket solenoid pilot valve to cooperatively drive said second bucket dumping meter-in valve and said second bucket dumping meter-out valve, and further, when the straight excavating operation mode is designated by said straight excavating operation mode designating means and the start of the straight excavating operation is instructed by said straight excavating operation instructing means, for controlling said third bucket pilot valve, said bucket solenoid pilot valve and said third bucket meter-out pilot valve so that a difference between the set bucket angle of said bucket angle setting means and the detected bucket angle of said bucket angle sensor is set to be zero, wherein said bucket is automatically driven during the straight excavation operation so as to hold said boom to be in the floated state and to keep said bucket to be coincident with the set bucket angle.

2. The apparatus as claimed in claim 1, wherein said means for instructing start and stop of the straight excavating operation is a switch disposed on a knob selected from the group consisting of said first actuation lever and said second actuation lever.

3. The apparatus as claimed in claim 1 further including float setting pressure selecting switch means for setting a degree of opening of said first boom meter-out valve to a plurality of different opening degrees in accordance with soil conditions, wherein said first control means controls, when the straight excavating operation is performed, said second boom pilot valve in accordance with the opening degree set by said float setting pressure selecting switch means.

4. The apparatus as claimed in claim 1, wherein said second control means includes:

adding means, when the bucket actuation signal of said bucket actuation lever is input during the straight excavating operation, for adding the actuation signal to the set bucket angle of said bucket angle setting means; and drive control means for controlling said third bucket pilot valve, said bucket solenoid pilot valve and said third bucket meter-out pilot valve so that a difference between the addition result of said adding means and the detected bucket angle of said bucket angle sensor is set to be zero.

* * * * *